US007395017B2

(12) United States Patent
Matsuzaki

(10) Patent No.: US 7,395,017 B2
(45) Date of Patent: Jul. 1, 2008

(54) IMAGE FORMING APPARATUS

(75) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 199 days.

(21) Appl. No.: 11/427,209

(22) Filed: Jun. 28, 2006

(65) Prior Publication Data

US 2006/0291912 A1 Dec. 28, 2006

(30) Foreign Application Priority Data

Jun. 28, 2005 (JP) ..... 2005-188679

(51) Int. Cl.
*G03G 15/08* (2006.01)

(52) U.S. Cl. ..... 399/279; 399/281; 399/284; 430/108.1

(58) Field of Classification Search ..... 399/279, 399/281, 284, 286; 430/108.1, 108.8, 110.1
See application file for complete search history.

(56) References Cited

U.S. PATENT DOCUMENTS 5,389,487 A * 2/1995 Kawakami et al. ..... 430/123.52
6,821,697 B2 * 11/2004 Takayanagi et al. ..... 430/108.4
6,858,365 B2 * 2/2005 Sawada et al. ..... 430/106.2

FOREIGN PATENT DOCUMENTS

JP 11-174732 A 7/1999
JP 2005-148097 A 6/2005

* cited by examiner

*Primary Examiner*—Hoang Ngo
(74) *Attorney, Agent, or Firm*—Panitch Schwarze Belisario & Nadel LLP

(57) ABSTRACT

An image forming apparatus prints an image on paper. A developing roller supplies toner to an electrostatic latent image on a photoconductive drum to form a toner image. A developing blade forms a thin layer of toner on the developing roller. A transfer unit transfers the toner image onto the paper. A fixing unit fixes the toner image on the paper into a permanent image. The developing roller rotates at a circumferential speed from 150 to 250 mm/sec. The developing blade applies a line pressure in the range of 34-68 gf/cm to the developing roller. The toner has a glass transition temperature Tg from 45 to 77□, a softening temperature from 58 to 98□, a flow-beginning temperature Ts from 78 to 138□, and a melting point Tm from 105 to 189□. Tg, Ts, Tfb and Tm are related such that Tm>Tfb>Ts.

17 Claims, 2 Drawing Sheets

IMAGE FORMING APPARATUS

BACKGROUND OF THE INVENTION

1. Field of the Invention

The present invention relates to an image forming apparatus.

2. Description of the Related Art

Conventional image forming apparatuses such as electrophotographic printers, copying machines, facsimile machines, and multi-function printers (MFP) employ an electrophotography technology that involves charging, exposing, developing, and transferring. A charging roller charges the surface of a photoconductive drum. An exposing unit illuminates the charged surface for the photoconductive drum in accordance with print data to form an electrostatic latent image on the photoconductive drum. A developing unit develops the electrostatic latent image with toner into a toner image. A transfer roller transfers the toner image onto paper. A fixing unit fuses the toner image on the paper into a permanent image.

After transferring the toner image onto the paper, a cleaning unit removes residual toner from the photoconductive drum.

It is required of a fixing unit that images are fixed at high speed with minimum heat energy. For this purpose, toner having a low glass transition temperature Tg is used for low-temperature fixing.

A toner having a low glass transition temperature Tg tends to cause offset and filming.

Offset is a phenomenon in which when a heat roller applies heat and pressure to the toner on the paper and then the paper is separated from the heat roller, some of the melted toner adheres to the heat roller, and the residual melted toner on the heat roller is then transferred onto the paper. The melted toner adhering to the paper causes unwanted residual images that appear on the paper at intervals of a distance equal to the circumference of the heat roller.

Filming is adhesion of melted toner to the developing blade that occurs due to heat and pressure given to the toner when the toner is rubbed between the developing blade and the developing roller.

SUMMARY OF THE INVENTION

An object of the present invention is to solve the drawbacks of conventional image forming apparatuses.

Another object of the invention is to provide an image forming apparatus that prevents offset and filming.

An image forming apparatus includes an image-bearing body, a developer-bearing body, a layer-forming member, a transfer unit, and a fixing unit. An electrostatic latent image is formed on the image-bearing body. A developer-bearing body is disposed to oppose the image-bearing body, supplying developer to the electrostatic latent image to form a visible image formed of the developer. The layer-forming member is in contact with said developer-bearing body and forms a thin layer of the developer on said developer-bearing body. The transfer unit transfers the visible image onto a recording medium. The fixing unit fixes the visible image into a permanent image. The developer-bearing body rotates at a circumferential speed of 150-250 mm/sec. The layer-forming member applies a line pressure in the range of 34-68 gf/cm on the developer-bearing body. The developer has a glass transition temperature in the range of 45-77° C., a softening temperature in the range of 58-98° C., a flow-beginning temperature in the range of 78-138° C., and a melting point in the range of 105-189° C. The melting point is higher than the flow-beginning temperature, and the flow-beginning temperature is higher than softening temperature.

The developer may have a glass transition temperature in the range of 45-77° C., a softening temperature in the range of 63-98° C., a flow-beginning temperature (Tfb) in the range of 83-138° C., and a melting point in the range of 109-189° C.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

The invention will be described in detail with reference to the drawings.

Figure 1:
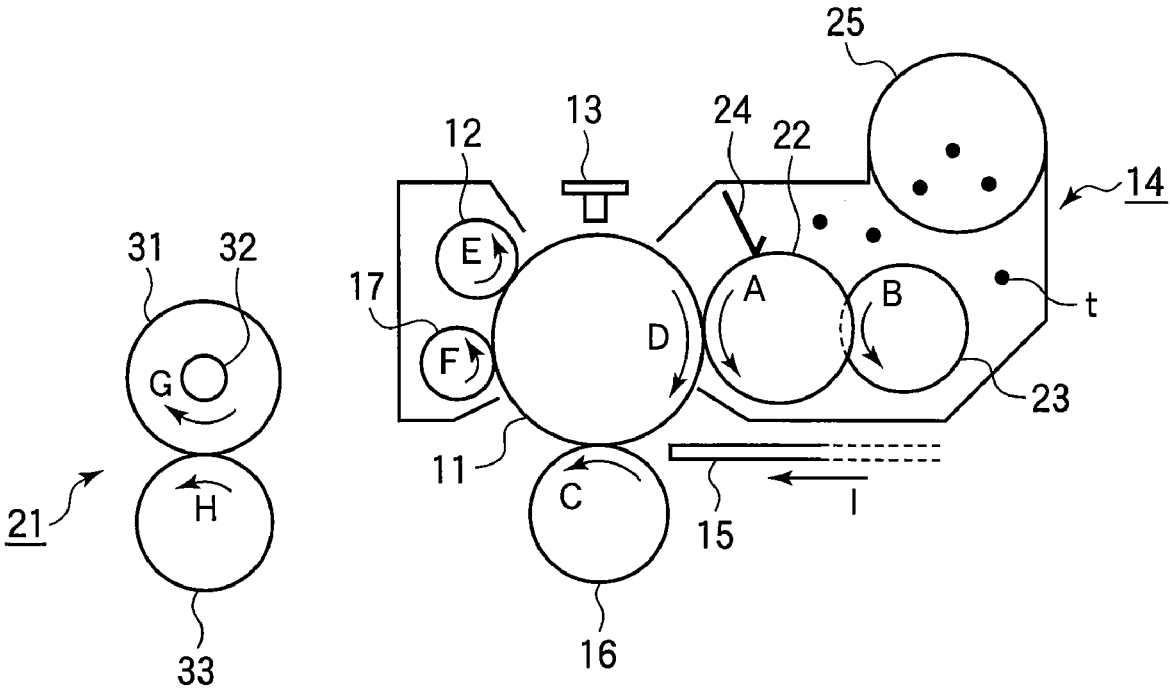
FIG. 1 illustrates the outline of an image forming apparatus according to a first embodiment.

FIG. 1 illustrates the outline of an image forming apparatus according to a first embodiment.

Referring to FIG. 1, the electrophotographic image forming apparatus performs charging, exposing, developing, transferring, and cleaning in electrophotographic technology. A charging roller 12 rotates in a direction shown by arrow E to charge the surface of a photoconductive drum 11 that rotates in a direction shown by arrow D. An LED head 13 illuminates the charged surface of the photoconductive drum 11 in accordance with print data to form an electrostatic latent image. A developing unit 14 supplies non-magnetic one-component toner to the electrostatic latent image to develop the electrostatic latent image into a toner image. A transfer roller 16 rotates in a direction shown by arrow C to transfer the toner image onto paper 15. A cleaning roller 17 rotates in a direction shown by arrow F to remove residual toner from the photoconductive drum 11 after transferring. A fixing unit 21 fixes the toner image on the paper 15 into a permanent image.

The developing unit 14 is disposed downstream of the LED head 13 with respect to the rotation of the photoconductive drum 11. The developing unit 4 includes a developing roller 22, a sponge roller 23, a developing blade 24, and a toner cartridge 25. The developing roller 22 extends in parallel to the photoconductive drum 11 and rotates in a direction shown by arrow A. The sponge roller 22 serves as a toner-supplying member that supplies toner t to the developing roller 22. The photoconductive drum 11, charging roller 12, developing unit 14, and cleaning roller 17 form an image forming section.

The photoconductive drum 11 rotates in contact with the charging roller 12, developing roller 22, transfer roller 16, and cleaning roller 17.

The developing roller 22 rotates in contact with the sponge roller 23 and developing blade 24. The photoconductive drum 11 an outer diameter of 30 mm. The developing roller 22 has an outer diameter of 18.39 mm. The developing roller 22 has a rotational metal shaft covered with a semi-conductive silicone rubber in which carbon black is dispersed.

The fixing unit 21 includes a heat roller 31 and a backup roller 33. The heat roller 31 includes an aluminum pipe covered with a resilient material such as tetrafluoride ethylene-per-fluoroalkylvinylether resin (PFA) or polytetrafluoroethylene (PTFE), and incorporates a halogen lamp 32 as a heat source. The backup roller 33 is covered with a resilient material. The backup roller 31 rotates in pressure contact with the heat roller 31 to define a fixing point between the heat roller 31 and backup roller 33. When the paper 15 passes through the fixing point, the heat roller 31 rotates in contact with a surface of the paper 15 on which a toner image is carried and the backup roller 33 rotates in contact with another surface of the paper 15 on which a toner image is not carried.

The heat roller 31 has an outer diameter of 19.9 mm and the backup roller 33 has an outer diameter of 22 mm. Because the backup roller 33 has a larger diameter than the heat roller 31, a nip is effectively formed between the heat roller 31 and backup roller 33 so that when the paper 15 passes through the nip, the toner image on the paper 15 is effectively fused.

The photoconductive drum 11, charging roller 12, developing roller 22, transfer roller 16, sponge roller 23, heat roller 31, and cleaning roller 17 have gears through which driving forces are transmitted to them. The developing roller 22 is coupled to the sponge roller 23 through an idle gear.

A power supply, not shown, applies bias voltages to the charging roller 12, transfer roller 16, developing roller 22 and sponge roller 23. The respective bias voltages are controlled by a controller, not shown.

{Operation}

The operation of the image forming apparatus of the aforementioned configuration will be described.

When the controller outputs a print instruction, a motor begins to rotate. The rotation of the motor is transmitted to the photoconductive drum 11 in rotation. The rotation of the photoconductive drum 11 is transmitted to the developing roller 22. The rotation of the developing roller 22 is then transmitted to the sponge roller 23. The rotation of the photoconductive drum 11 is also transmitted to the charging roller 12, cleaning roller 17, and transfer roller 16.

The rotation of the motor is transmitted to the heat-roller via several gears, not shown, and the heat roller 31 rotates in a direction shown by arrow G together with the backup roller 33. The backup roller 33 rotates in a direction shown by arrow H.

As soon as the motor begins to rotate, bias voltages are applied to the charging roller 12, developing roller 22, fixing unit 21, and transfer roller 16.

The entire circumferential surface of the photoconductive drum 11 is charged uniformly by the charging roller 12. The LED head 13 illuminates the charged surface of the photoconductive drum 11 to form an electrostatic latent image on the photoconductive drum 11. The developing blade 24 forms a thin layer of toner on the developing roller 22. As the developing roller 22 rotates, the thin layer of toner is brought into contact with the electrostatic latent image by the Coulomb force, and develops the electrostatic latent image into a toner image.

The toner image is then transferred onto the paper 15. The residual toner on the photoconductive drum 11 after transfer is removed by the cleaning roller 17, and is collected in a predetermined sequence under control of the controller. The paper 15 having the toner image thereon is advanced to the fixing unit 21. The paper 15 passes through a fixing point defined between the heat roller 31 and backup roller 33, so that the toner image is fused with the combination of heat and pressure in the fixing unit 21.

{Tg, Ts, Tfb, and Tm of Toner}

Toner according to the present invention is characterized in terms of softening temperature Ts, flow beginning temperature Tfb, and melting point Tm. Ts, Tfb, and Tm of a toner can be determined by obtaining the flow test curve (or stroke-temperature curve) of the toner. The flow test curve of a toner is the relation between the position of piston of a flow tester and the temperature of the toner, and can be obtained by heating the toner in a flow tester under a predetermined load. For example, the flow test curve of a toner can be obtained by constant heating rate method in which the toner is heated at a predetermined rate of increase in temperature. Constant heating rate method enables the measurement of the transition of toner particles through a solid state, a rubbery state, and a fluid state.

Figure 2:
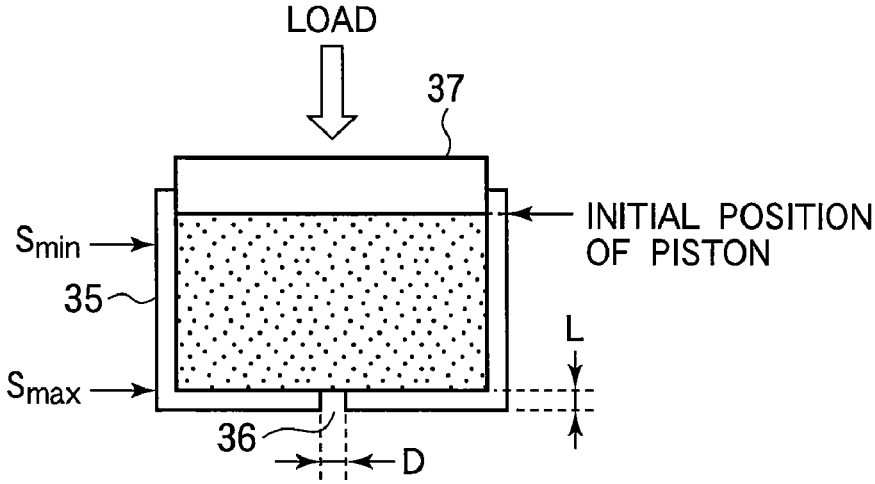
FIG. 2 illustrates the flow tester used in the first embodiment.

FIG. 2 illustrates a flow tester used in the first embodiment.

Referring to FIG. 2, a cylindrical toner reservoir 35 has a diameter of 10 mm. The toner reservoir 35 includes a die 36 in its bottom and the die 36 having a diameter D of 1 mm and a length L of 1 mm. The toner reservoir 35 holds 1 gram of toner. A piston 37 applies a load of 20 kg to the toner. The toner is then heated by increasing the temperature at a rate of 6° C./min.

Figure 3:
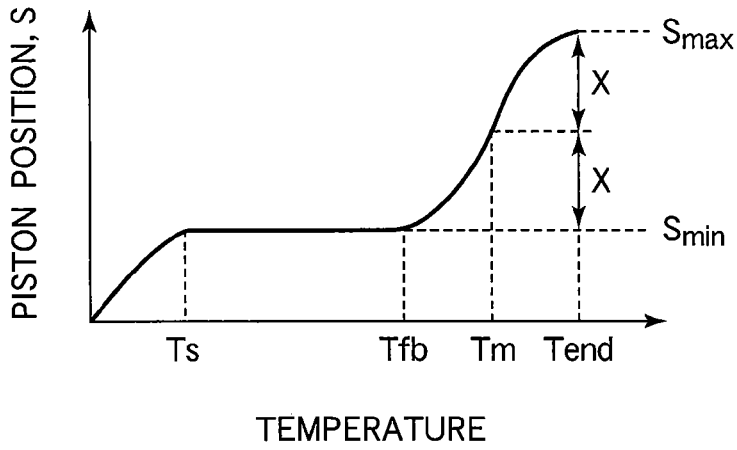
FIG. 3 illustrates the flow test curve of a toner.

FIG. 3 illustrates the flow test curve of a toner determined by using a flow tester. FIG. 3 plots temperature as the abscissa and piston position as the ordinate. The flow tester displays Ts, Tfb, and Tm on its display section.

"Tg" is the "glass transition temperature" of a polymer phase. The glass transition temperature of a polymer is the temperature below which the polymer is in a rigid, glassy state at temperatures and above which the polymer is in a fluid or rubbery state. The glass transition temperature Tg of the toner can be measured by heating 10 mg of toner with a differential scanning calorimeter (Model DSC-7 available form PERKIN-ELMER) at a rate of temperature increase of 80° C./min.

"Ts" is a softening temperature, i.e., the temperature at which air escapes from gaps among the toner particles and the toner becomes apparently a single uniform layer while having a non uniform distribution of stress.

"Tfb" is a flow-beginning temperature (flow-start temperature), i.e., the temperature at which the piston 37 is pushed up slightly due to thermal expansion of the toner, and then the piston 37 begins to go down.

"Tm" is a melting point, i.e., the temperature when the piston 37 is at a given by X+Smin and X=(Smax−Smin)/2, where Smin is a piston position at which the melted toner begins to flow and Smax is a piston position at which toner stops flowing.

The aforementioned image forming apparatus operates at the following conditions.

(1) The developing roller 22 rotates at a circumferential speed in the range of 150-250 mm/sec, preferably 200-250 mm/sec.

(2) The line pressure of the developing blade 24 applied to the developing roller 22 is in the range of 34-68 gf/cm.

When the image forming apparatus operates at the above-mentioned conditions (1) and (2), a toner that meets the following conditions is used.

(a) The glass transition temperature Tg of the toner is in the range of 45-77° C.

(b) The softening temperature Ts is in the range of 58-98° C.

(c) The flow-beginning temperature Tfb is in the range of 78-138° C.

(d) The melting point Tm is in the range of 105-189° C.

(e) Tfb is higher than Ts, and Tm is higher than Tfb.

In the present invention, Ts, Tfb, and Tm were measured with a flow tester (Model CFT-500, available from SHIMADZU).

{Method of Manufacturing Toner}

The method of manufacturing the toner will be described.

The following materials were put in a powdering machine (Attriter MA-01SC, manufactured by Mitsui Miike Chemical Industry): 77.5 parts by weight of styrene, 22.5 parts by weight of acrylic acid-N-butyl as a binder resin, 2 parts by weight of low molecular weight polyethylene as an offset-preventing agent, 1 part by weight of AIZEN SPILON BLACK THR as a charge control agent (Hodogaya Corporation), 6 parts by weight of carbon black (Printex L, manufactured by Degussa Corporation), and 1 part by weight of 2,2' azobisisobutyronitrile as a coloring agent. Then, the materials were dispersed at 15° C. for 10 hours to obtain a polymerizable composition. Then, ethanol is prepared in which 8 parts by weight of polyacrylic acid and 0.35 parts by weight of divinylbenzene were dissolved. Then, 600 parts by weight of distilled water is added to the thus prepared ethanol to prepare dispersion medium for polymerization. The previously prepared polymerizable composition is then added to the dispersion medium and dispersed at 15° C. and 8000 rpm for 10 minutes using a TK homomixer (M-type, manufactured by TOKUSHUKIKA KOGYOSHA). Then, the thus dispersed solution was put in a separable flask of 1-liter capacity and allowed to react at 85° C. for 12 hours while agitating in the flow of nitrogen at 100 rpm.

Subsequently, an emulsion was prepared in an aqueous suspension of the intermediate particles by using an ultrasonic oscillator (the Model US-150ib available from NIPPON SEIKI SEISAKUSHO), the emulsion being formed of 0.925 weight parts methyl methacrylate, 0.75 weight parts acrylic acid-n-butyl, 0.5 weight parts azobisisobutyronitrile, 0.1 weight parts sodium laurylsuphate, and 80 weight pats water. Then, the emulsion by 9 weight parts was dripped to cause the intermediate particles to swell. Shortly after the dripping was complete, the material was observed under an optical microscope. No emulsion was observed. This indicates that swelling has completed in a very short time. Then, the material was allowed to react while being agitated in a nitrogen atmosphere for 10 hours at 85° C., thereby completing the second stage of polymerization.

After cooling, the dispersed solution was dissolved in a 0.5 N aqueous solution of hydrochloric acid, then filtered and washed with water, and finally air-dried. Then, the dried material was further dried at a low pressure of 10 mm Hg and at 40° C. for 10 hours, and was then air-classified with an air-classifier so that a toner having an average particle diameter of 7 μm was obtained.

Then, 0.35 parts by weight of hydrophobic ultra fine silica "Aerosil R-972" from Aerosil Japan was added to 50 parts by weight of the toner, and was mixed to prepare toner C. Likewise, toners A, B, and D-F were manufactured by selecting the types of materials and amounts of additives.

The softening temperature Ts of a toner can be changed by selecting the ratio of styrene to acrylic. Large ratios of styrene to acrylic generally cause higher softening temperatures Ts. Tfb and Tm may be increased by adding substances referred to as a cross-linking agent with minimum change in Ts.

Resins used for manufacturing toners according to the embodiment include thermal plastic resins such as vinyl resin, polyamide resin, and polyester resin. Polymers for vinyl resin include stylenes such as 2,4-dimethylstylene, -methylstylene, p-ethylstylene, O-methylstylene, m-methylstylene, p-methylstylene, p-chlorostylene, vinylnaphthalene, or styrene derivatives; ethylenic monocarboxylic acids such as 2-ethylehexylacrylate, methyl methacrylate, methyl acrylate, ethyl acrylate, n-propyl acrylate, isobutyl acrylate, t-butyl acrylate acrylic-t-butyl, amyl acrylate, cyclohexyl acrylate, n-octylacrylate, isooctyl acrylate, decylacrylate, lauryl acrylate, stearyl acrylate, methoxyethyl acrylate, 2-hydroxyethyl acrylate, glycidyl acryalte, phenyl acrylate, chloromethyl acrylate, methacrylic acid, ethyl methacrylate, n-propyl methacrylate, isopropyl methacrylate, n-butyl methacrylate, isobutyl ethacrylate, t-butyl methacrylate, amyl methacrylate, cyclohexyl methacrylate, n-octyl methacrylate, isooctyl methacrylate, decyl, ethacrylate, lauryl methacrylate, 2-ethyl hexyl methacrylate, stearyl methacrylate, hydroxyethyl-2-methacrylate, 2-ethyl hexyl methacrylate, glycidyl methacrylate, phenyl methacrylate, dimetyl amino methacrylate, and dietyl amino methacrylate, and esters of these ethylenic monocarboxylic acids; ethylenic unsaturated monoolefins such as ethylene, propylene, butylene, and isobutylene; vinyl esters such as vinyl chloride, vinyl bromoacetate, vinyl propionate, vinyl formate, vinyl caprorate; ethylenic monocarboxylic acids and its substitution such as acrylate nitrile, methacrylonitrile, and acrylamide; ethylenically dicarboxylic acid and its substitution product, for example, vinyl ketones such as vinyl methyl ketone and vinyl methyl ethers such as vinyl ethyl ether.

The cross-linking agent includes divinylbenzene, divinyl naphthalene, polyethylene glycol dimethacrylate, 2,2'-bis-(4-methacryloxydiethoxydiphenyl)propane, 2,2'-bis-(4-acryloxydiethoxydiphenyl)propane, diethylene glycol diacrylate, triethylene glycol diacrylate, 1,3-butylenglycol dimethacrylate, 1,6-hexylene glycol dimethacrylate, neopentyl glycol dimethacrylate, dipropylene glycol dimethacrylate, polypropylene glycol dimethacrylate, trimethylolpropane trimethacrylate, trimethylolpropane triacrylate, and tetramethylolmethanetetraacrylate. Alternatively, more than one of these cross-linking agents may be combined.

Table 1 lists the Tg, Ts, and Tfb of the thus manufactured toners A-F.

TABLE 1

| | TONER | | | | | | | |
|---|---|---|---|---|---|---|---|---|
| | A | B | C | D | E | F | G | H |
| Tg (° C.) | 45 | 45 | 45 | 57 | 77 | 77 | 43 | 80 |
| Ts (° C.) | 53 | 58 | 63 | 70 | 98 | 99 | 53 | 99 |
| Tfb (° C.) | 78 | 78 | 83 | 118 | 138 | 143 | 75 | 145 |
| Tm (° C.) | 105 | 105 | 109 | 168 | 189 | 195 | 100 | 195 |

{Evaluation of Filming, Fixing Performance, and Offset}

Using the image forming apparatus in FIG. 1, continuous printing at a print duty of 1% was performed on 30,000 pages of A4 size paper 15 for different circumferential speeds of the developing roller 22 and different line pressures of the developing blade 24 applied to the developing roller 22.

After printing 30,000 pages, the following four types of printing were performed.

A solid image of a density of 100% was printed on a sheet of paper with the surface of the heat roller 31 heated to 195° C.

A halftone image (2 by 2 pattern) was printed on a sheet of paper with the surface of the heat roller 31 heated to 195° C.

A character images (5% duty) was printed on a sheet of paper at a density of 5% with the surface of the heat roller 31 heated to 195° C.

A composite image having a solid image, a half-tone image and character image on a page was printed.

The 100% duty means printing on the printable area of paper in its entirety. When printing is performed in an area corresponding to 1% of a printable area of paper, the print duty is said to be 1% duty. The halftone is printing performed in an area equal to 2 dots by 2 dots in a printable area consisting of 4 dots by 4 dots.

Shortly after the continuous printing has been completed, a few samples of print result were obtained for evaluating filming on the developing blade 24 and fixing performance.

The heat roller 31 and backup roller 33 rotated at the same circumferential speed as the developing roller 22.

Shortly after the continuous printing of 30,000 pages, the temperature of the fixing unit 21 has increased, and therefore evaluation cannot be performed as to whether offset is present or absent. If printing is started when the temperature of the fixing unit 21 is sufficiently low, the temperature of the fixing unit will increase to overshoot above an upper limit, leading to offset. In contrast, after continuous printing, the fixing unit 21 has reached a high temperature. Therefore, overshoot is difficult to occur and therefore offset is difficult to occur. Thus, accurate evaluation of offset is difficult.

In the present embodiment, after continuous printing of 30,000 pages, a sufficient time is allowed before the fixing unit 21 has been cooled down to a sufficiently low temperature. Then, a few pages were printed when the fixing unit 21 has been cooled down, for example, on the next morning. Offset was evaluated only by using a composite image.

Tables 2, 3, 4, and 5 list evaluation results for toners A, F, G, and H. Tables 6A and 6B list evaluation results for toners B to E.

For Table 2 to Tables 6A and 6B, if white streaks extending in a direction of travel of the paper 15 do not appear on a solid image, it is determined that filming has not occurred. If white streaks appear on a solid image, it is determined that filming has occurred. When a solid image is rubbed with a finger, if the toner does not fall from the solid image, it is determined that fixing performance is good. If the toner falls from the solid image, it is determined that fixing performance is poor.

When a residual image appears on the printed image at distance intervals equal to the circumference of the heat roller 31, it is determined that some offset has occurred, and indicated by "POOR."

When a residual image does not appear on the printed image at distance intervals equal to the circumference of the heat roller 31, it is determined that offset has not occurred, and indicated by "GOOD."

Only when a residual image of solid image appears on the first page, it is determined that some offset has occurred, and indicated by "FAIR."

When a residual image of solid image appears on the second page onward or a residual image of an image other than a solid image appears on the first page, it is determined that offset has occurred, and indicated by "POOR."

When continuous printing is performed, the higher the circumferential speed and the higher the line pressure, the more chance of filming. The higher the circumferential speed is, the poorer the fixing performance is. The lower the circumferential speed is, the more chance of offset is.

TABLE 2

| TONER A | COMPARISON 1-1 | COMPARISON 1-2 |
|---|---|---|
| CIRCUMFERENTIAL SPEED (mm/sec) | 150 | 150 |
| LINE PRESSURE (gf/cm) | 30 | 34 |
| FILMING | no sample | POOR |
| FIXING PERFORMANCE | no sample | GOOD |
| OFFSET | no sample | no sample |

For Comparison 1-1, the line pressure was too low to form a thin layer of toner on the developing roller 22. Therefore, printing results were not good during initial printing. For Comparison 1-2, filming occurred. From the results of Comparison 1-2, if the line pressure is higher than 34 gf/cm and/or the circumferential speed is higher than 150 mm/sec, filming occurs. Thus, if the line pressure is higher than 34 gf/cm and/or the circumferential speed is higher than 150 mm/sec, evaluation was not made. Filming occurred for Comparison 1-2 and therefore no evaluation of offset was made on the next morning.

TABLE 3

| TONER F | COMPARISON 1-3 | COMPARISON 1-4 |
|---|---|---|
| CIRCUMFERENTIAL SPEED (mm/sec) | 150 | 150 |
| LINE PRESSURE (gf/cm) | 34 | 68 |
| FILMING | GOOD | GOOD |
| FIXING PERFORMANCE | POOR | POOR |
| OFFSET | no sample | no sample |

For Comparisons 1-3 and 1-4, after continuous printing of a solid image on 30,000 pages, if a solid image was rubbed with a finger, the toner fell off, i.e., poor fixing performance. For this reason, offset of Comparisons 1-3 and 1-4 were not evaluated.

For Comparisons 1-3 and 1-4, evaluation was made at a circumferential speed of 150 mm/sec. The fixing performance was no good at a circumferential speed of 150 mm/sec and was even worse at circumferential speeds higher than 150 mm/sec. For circumferential speeds higher than 150 mm/sec, no evaluation was made.

TABLE 4

| TONER G | COMPARISON 1-5 | COMPARISON 1-6 |
|---|---|---|
| CIRCUMFERENTIAL SPEED (mm/sec) | 150 | 150 |
| LINE PRESSURE (gf/cm) | 30 | 34 |
| FILMING | no sample | POOR |
| FIXING PERFORMANCE | no sample | GOOD |
| OFFSET | no sample | no sample |

For Comparison 1-5, the line pressure was too low to form a thin layer of toner on the developing roller 22. Printing results were not good during initial printing.

The conditions for Comparison 1-6 caused filming, and therefore it follows that filming occurs if the line pressure is higher than 34 gf/cm and/or the circumferential speed is higher than 150 mm/sec. Thus, from the results of Comparison 1-6, if the line pressure is higher than 34 gf/cm and/or the circumferential speed is higher than 150 mm/sec, evaluation was not performed. Filming occurred for Comparison 1-6 and therefore evaluation was not performed on the next morning.

TABLE 5

| TONER H | COMPARISON 1-7 | COMPARISON 1-8 |
|---|---|---|
| CIRCUMFERENTIAL SPEED (mm/sec) | 150 | 150 |
| LINE PRESSURE (gf/cm) | 34 | 68 |
| FILMING | GOOD | GOOD |
| FIXING PERFORMANCE | POOR | POOR |
| OFFSET | no sample | no sample |

For Comparisons 1-7 and 1-8, when a solid image was rubbed with a finger, the toner fell off the solid image. In other words, fixing performance was not good. Thus, offset was not evaluated for Comparisons 1-7 and 1-8.

For Comparisons 1-7 and 1-8, evaluation was made at a circumferential speed of 150 mm/sec. The fixing performance was poor at a circumferential speed of 150 mm/sec and was even worse at circumferential speeds higher than 150 mm/sec. Therefore, evaluation was therefore not made for circumferential speeds higher than 150 mm/sec.

Comparisons 1-7 and 1-8 were evaluated by using toners B to E. The evaluation results were the same for toners B to E.

TABLE 6A

| TONERS J-L | COM 1-9 | COM 1-10 | COM 1-11 | COM 1-12 | COM 1-13 | COM 1-14 |
|---|---|---|---|---|---|---|
| CIRCUMFERENTIAL SPEED (mm/sec) | 130 | 130 | 150 | 150 | 270 | 270 |
| LINE PRESSURE | 34 | 68 | 30 | 73 | 34 | 68 |
| FILMING | GOOD | GOOD | — | POOR | POOR | POOR |
| FIXING | GOOD | GOOD | — | GOOD | GOOD | GOOD |
| OFFSET | POOR | POOR | — | — | — | — |

For Comparison 1-12, filming occurred at a circumferential speed of 150 mm/sec and a line pressure of 73 gf/cm. This indicates that filming occurs at circumferential speeds higher than 150 mm/sec and at a line pressure of 73 gf/cm. Evaluation was not performed for circumferential speeds higher than 150 mm/sec at a line pressure of 73 gf/cm.

For Examples 1-1 to 1-5, residual solid images were observed on the first sheet. The residual solid images were not serious and were not observed on the second sheet onward.

For Examples 1-1 to 1-5, evaluation was made for different line pressures at a fixed circumferential speed of 150 mm/sec. Evaluation results for Examples 1-1 to 1-5 were the same in terms of filming, fixing performance, and offset, i.e., filming did not occur and fixing performance was good. No serious offset occurred.

For Examples 1-6 and 1-7, evaluation was made for different line pressures at a fixed circumferential speed of 200 mm/sec. For examples 1-8 and 1-9, evaluation was made for different line pressures at a fixed circumferential speed of 250 mm/sec. For Examples 1-6, 1-7, 1-8, and 1-9, the evaluation results were the same, i.e., filming did not occur. Fixing performance was good. Offset did not occur.

Evaluation was performed in a mid-humidity and mid-temperature environment where temperature is 23° C. and humidity is 55%. Similar evaluation results were obtained in the following two different environments: a low-humidity and low-temperature environment where temperature is 10° C. and humidity is 20%, and a high-temperature and high-humidity environment where temperature is 28° C. and humidity is 80%.

The present embodiment uses polymerized toner which is manufactured by chemical polymerization. The evaluation results will not vary depending on the manufacturing process of toner as long as Tg, Ts, Tfb, and Tm are within the aforementioned ranges.

In the present embodiment, slight offset occurred when the circumferential speed was lower than 200 mm/sec. However, the offset occurred only at limited conditions and was practically not serious.

TABLE 6B

| TONERS J-L | EX 1-1 | EX 1-2 | EX 1-3 | EX 1-4 | EX 1-5 | EX 1-6 | EX 1-7 | EX 1-8 | EX 1-9 |
|---|---|---|---|---|---|---|---|---|---|
| CIRCUMFERENTIAL SPEED (mm/sec) | 150 | 150 | 150 | 150 | 150 | 200 | 200 | 200 | 200 |
| LINE PRESSURE | 34 | 43 | 52 | 60 | 68 | 34 | 68 | 34 | 68 |
| FILMING | GOOD | GOOD | GOOD | GOOD | GOOD | GOOD | GOOD | GOOD | GOOD |
| FIXING | POOR | POOR | POOR | POOR | POOR | POOR | POOR | POOR | POOR |
| OFFSET | FAIR | FAIR | FAIR | FAIR | FAIR | GOOD | GOOD | GOOD | GOOD |

For Comparisons 1-9 to 1-10, at a line pressure in the range of 34-68 gf/cm, evaluation results were the same in terms of filming, fixing, and offset, i.e., filming did not occur, fixing results were good, and offset occurred.

For Comparison 1-11, the line pressure was too low to form a thin layer of toner on the developing roller 22 and therefore good print results were not obtained during initial printing. Evaluation was not performed for circumferential speeds higher than 150 mm/sec at a line pressure of 30 gf/cm.

For Comparisons 1-12 to 1-14, the evaluation results were the same in terms of filming and fixing performance at line pressures lower than 73 gf/cm, i.e., fixing results were good but filming occurred. Because filming occurred, offset was not evaluated on the next morning.

Filming and offset can be prevented and fixing performance can be improved, thus improving image quality if the toner satisfies the following conditions:

(1) The circumferential speed is in the range of 150-250 mm/sec, preferably 200-250 mm/sec, and the line pressure in the range of 34-68 gf/cm;

(2) Tg is in the range of 45-77° C.;

(3) Ts is in the range of 58-98° C.;

(4) Tfb is in the range of 78-138° C.;

(5) Tm is in the range of 105-189° C.; and (6) Ts<Tfb<Tm.

In the present invention, because not only Tg but also Ts, Tfb, and Tm contribute to improving the characteristics of toner, filming and offset can be prevented and fixing performance is improved.

Second Embodiment

Elements similar to those in the first embodiment have been given the same reference numerals and their description is omitted.

Figure 4:
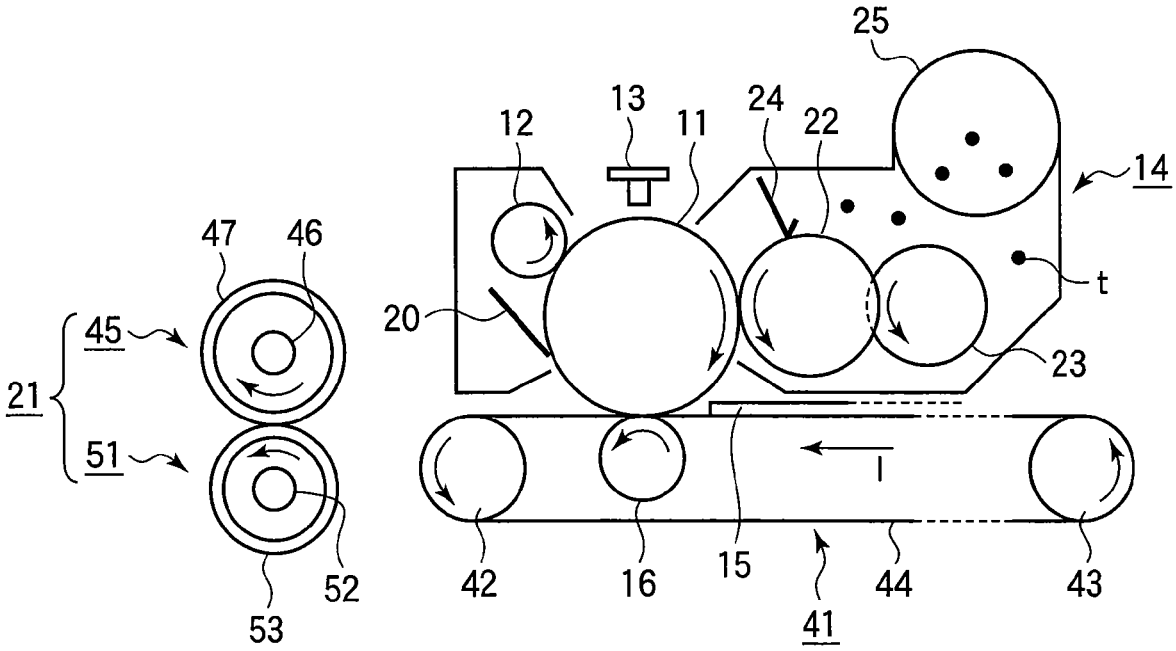
FIG. 4 is a schematic view of an image forming apparatus according to a second embodiment.

FIG. 4 is a schematic view of an image forming apparatus according to a second embodiment.

Referring to FIG. 4, a transfer unit 41 transfers a toner image onto the paper 15 while transporting the paper 15. The transfer unit 41 includes a drive roller 42, a driven roller 43, a seamless belt 44 that is entrained about the drive roller 42 and driven roller 43 and runs in a direction shown by an arrow I when the drive roller 42 is driven in rotation, and a transfer roller 16 that opposes the photoconductive drum 11 with the belt 44 sandwiched between the transfer roller 16 and the photoconductive drum 11. The residual toner on the photoconductive drum 11 is scraped by the cleaning blade 20 and, is collected into a toner collecting section, not shown.

The photoconductive drum 11 has an outer diameter of 29.95 mm and the developing roller 22 has an outer diameter of 19.6 mm. The developing roller 22 includes a metal shaft covered with a semi-conductive urethane rubber in which carbon black is dispersed.

The fixing unit 21 includes a heat roller 45 incorporating a halogen lamp 46, and a backup roller 51 incorporating a halogen lamp 52. The heat roller 45 is cylindrical, and opposes the paper 15. The backup roller 51 is in pressure contact with the heat roller 45. The heat roller 45 is covered with a resilient layer 47 and the backup roller 51 is covered with a resilient layer 53.

The heat roller 45 has an outer diameter of 27.9 mm and the backup roller 51 has an outer diameter of 36.1 mm. Because the heat roller 45 has a larger diameter than the backup roller 51, the contact area defines a good nip between the heat roller 45 and backup roller 51 where the toner image on the paper 15 is effectively fused.

In the second embodiment, the circumferential speed of the developing roller 22 is in the range of 150-250 mm/sec, preferably 200-250 mm/sec. The line pressure of the developing blade 24 exerted on the developing roller 22 is in the range of 34-68 gf/cm. Toners used in the second embodiment meet the following requirements:

(1) Tg is in the range of 45-77° C.;

(2) Ts is in the range of 63-98° C.;

(3) Tfb is in the range of 83-138° C.; and (4) Tm is in the range of 109-189° C.

Toners according to the second embodiment were manufactured in the following process.

The following materials were placed in a Henschel mixer (available from MITSUI-MIIKE KAKOKI): 100 weight parts of polyester resin (number average molecular weight Mn=3700, glass transition temperature Tg=62° C.), 1 weight parts of salicylic acid complex as a charge control agent, and 3 weight parts of phthalocyanine blue (C.I. Pigments Blue 15:3) as a coloring agent, and 10 weight parts of wax that prevents the melted toner from becoming tacked to the fixing roller (glass transition temperature Tg=100° C.). The mixture in the Henschel mixer is sufficiently agitated and kneaded. Then, the material is heated in a continuous kneader of the open type ("Kneadex" manufactured by MITSUI MINING CO., LTD) to melt at a temperature of 100° C. for 3 hours, then kneaded, and finally cooled to room temperature. Then, this kneaded material was pulverized by using a dispersion separator (available from NIPPON PNEUMATIC MFG., CO. LTD) based on jet stream, and classified with a wheel air-stream classifier of the dry type (Micron separator manufactured by HOSOKAWA MICRON CO., LTD) to obtain toner as coloring particles having an average diameter of 8 μm.

Then, 100 weight parts of the thus manufactured toner and 2 weight parts of silica R972 (Aerosil Japan) as an external additive were placed in a Henschel mixer and was mixed for 90 sec at 1000 rpm, thereby adding the silica to the surface of the toner to manufacture toner I. In a similar manner, toners G, H, J, and K were manufactured with different materials and different amounts of additive.

Thermal characteristics of the toners can be controlled by selecting the molecular weight and glass transition temperature Tg of a binding resin, and the melting point of a wax. In order to increase the values of the thermal characteristics, the molecular weight and the glass transition temperature Tg of a binding resin, or the melting point of a wax can be increased. In order to decrease the values of the thermal characteristics, the molecular weight and the glass transition temperature Tg of a binding resin, or the melting point of a wax can be decreased. Thus, toners having desired thermal characteristics can be manufactured by properly combining the molecular weight of a binding resin, the glass transition temperature Tg of the binding resin, and the melting point of a wax.

The binder resins according to the present embodiment include styrene resins, acrylic resins, styrene-acrylic resins, and polyester resins.

The waxes include, for example, ester wax, paraffin wax, microcrystalline wax, polypropylene, and polyethylene. These agents may be used alone or in combination. The additive is preferably in the range of 1-10 by weight percent for 100 weight percent of toner.

Carbon black that is used as a toner for color printers may be used as a colorant. The following materials may also be conveniently used: C.I. pigment blue 15:3; C.I. pigment blue 15; C.I. pigment blue 15:6; C.I. pigment blue 68; 2,9-dimethyl quinacridone; C.I. pigment yellow 17; C.I. pigment yellow 81; C.I. pigment yellow 154; and C.I. pigment yellow 185.

Additives include silica (inorganic fine particles), titanium oxide, aluminum oxide, barium titanate, and strontium titanate whose population mean particle diameter is in the range of 5-1000 nm. These additives may be hydrophobized. The amount of inorganic fine particles may be in proportions of 0.1-3.0 weight percent to coloring particles.

Higher fatty acid such as zinc stearate having a population mean particle diameter in the range of 0.1-2.0 μm may be added as a cleaning aid to the toners. The amount of additive as a cleaning aid is preferably in proportions of 0.01-1.0 weight percent to the coloring particles.

Table 7 lists the Tg, Ts, Tfb, and Tm of the aforementioned toners I-O.

TABLE 7

| | TONER | | | | | | |
|---|---|---|---|---|---|---|---|
| | I | J | K | L | M | N | O |
| Tg (° C.) | 45 | 45 | 62 | 77 | 77 | 43 | 80 |
| Ts (° C.) | 58 | 63 | 88 | 98 | 99 | 53 | 99 |
| Tfb (° C.) | 78 | 83 | 95 | 138 | 143 | 75 | 145 |
| Tm (° C.) | 105 | 109 | 125 | 189 | 195 | 100 | 195 |

{Evaluation of Filming, Fixing Performance, and Offset}

Using the image forming apparatus in FIG. 4, printing was performed in the same manner as the first embodiment at different circumferential speeds of the developing roller 22 and under different line pressures of the developing blade 24. The surface temperature of the heat roller 45 was set to 200° C., and the surface temperature of the backup roller 51 was set to 125° C. The heat roller 45 and backup roller 51 are rotated at the same circumferential speed as the developing roller 22. Tables 8 to 11 list evaluation results for the toners I, N, M and O. Tables 12A and 12B list evaluation results for toners J to L.

TABLE 8

| TONER I | COMPARISON 2-1 | COMPARISON 2-2 |
|---|---|---|
| CIRCUMFERENTIAL SPEED (mm/sec) | 150 | 150 |
| LINE PRESSURE (gf/cm) | 30 | 34 |
| FILMING | no sample | POOR |
| FIXING PERFORMANCE | no sample | GOOD |
| OFFSET | no sample | no sample |

For Comparison 2-1, the line pressure was too low to form a thin layer of toner on the developing roller 22, and therefore print quality was no good during initial printing. For Comparison 2-2, filming occurred. The results for Comparison 2-2 imply that filming occurs if the line pressure is higher than 34 gf/cm and/or the circumferential speed is higher than 150 mm/sec. Thus, from the results of Comparison 2-2, if at least one of the line pressure and circumferential speed is higher than those for Comparison 2-2, no evaluation was made. Additionally, because filming occurred for Comparison 2-2, offset for Comparison 2-2 was not evaluated on the next morning.

TABLE 9

| TONER N | COMPARISON 2-3 | COMPARISON 2-4 |
|---|---|---|
| CIRCUMFERENTIAL SPEED (mm/sec) | 150 | 150 |
| LINE PRESSURE (gf/cm) | 30 | 34 |
| FILMING | no sample | POOR |
| FIXING PERFORMANCE | no sample | GOOD |
| OFFSET | no sample | no sample |

For Comparison 2-3, the line pressure was too low to form a thin layer of toner on the developing roller 22, and therefore print quality was no good during initial printing. For Comparison 2-4, filming occurred. In other words, if the line pressure is higher than 34 gf/cm and/or the circumferential speed is higher than 150 mm/sec, filming occurs. Therefore, from the results of Comparison 2-4, if the line pressure is higher than 34 gf/cm and/or the circumferential speed is higher than 150 mm/sec, evaluation was not performed. Because filming occurred for Comparison 2-4, evaluation was not performed on the next morning.

TABLE 10

| TONER M | COMPARISON 2-5 | COMPARISON 2-6 |
|---|---|---|
| CIRCUMFERENTIAL SPEED (mm/sec) | 150 | 150 |
| LINE PRESSURE (gf/cm) | 34 | 68 |
| FILMING | GOOD | GOOD |
| FIXING PERFORMANCE | POOR | POOR |
| OFFSET | no sample | no sample |

For Comparisons 2-5 and 2-6, when a solid image printed on a sheet is rubbed with a finger, the toner fell from the sheet, i.e., fixing performance was no good. Therefore, offset was not evaluated for Comparisons 2-5 and 2-6.

For Comparisons 2-5 and 2-6, the circumferential speed was 150 mm/sec and the fixing performance was not good. This suggests that circumferential speeds higher than 150 mm/sec would result in even worse fixing performance. Thus, evaluation was not performed for circumferential speeds higher than 150 mm/sec.

TABLE 11

| TONER O | COMPARISON 2-7 | COMPARISON 2-8 |
|---|---|---|
| CIRCUMFERENTIAL SPEED (mm/sec) | 150 | 150 |
| LINE PRESSURE (gf/cm) | 34 | 68 |
| FILMING | GOOD | GOOD |
| FIXING PERFORMANCE | POOR | POOR |
| OFFSET | no sample | no sample |

For Comparisons 2-7 and 2-8, after continuous printing of 30,000 pages, when a solid image on a sheet was rubbed, the toner fell from the solid image, i.e., fixing performance was poor. Therefore, the offset was not evaluated for Comparisons 2-7 and 2-8.

For Comparisons 2-7 and 2-8, the circumferential speed was 150 mm/sec and the fixing performance was poor. This implies that circumferential speeds higher than 150 mm/sec would make the fixing performance even worse. Therefore, evaluation was not made for circumferential speeds higher than 150 mm/sec.

TABLE 12A

| TONERS J-L | COM 2-9 | COM 2-10 | COM 2-11 | COM 2-12 | COM 2-13 | COM 2-14 |
|---|---|---|---|---|---|---|
| CIRCUMFERENTIAL SPEED (mm/sec) | 130 | 130 | 150 | 150 | 270 | 270 |
| LINE PRESSURE | 34 | 68 | 30 | 73 | 34 | 68 |
| FILMING | GOOD | GOOD | — | POOR | POOR | POOR |
| FIXING | GOOD | GOOD | — | GOOD | GOOD | GOOD |
| OFFSET | POOR | POOR | — | — | — | — |

TABLE 12B

| TONERS J-L | EX 2-1 | EX 2-2 | EX 2-3 | EX 2-4 | EX 2-5 | EX 2-6 | EX 2-7 | EX 2-8 | EX 2-9 |
|---|---|---|---|---|---|---|---|---|---|
| CIRCUMFERENTIAL SPEED (mm/sec) | 150 | 150 | 150 | 150 | 150 | 200 | 200 | 200 | 200 |
| LINE PRESSURE | 34 | 43 | 52 | 60 | 68 | 34 | 68 | 34 | 68 |

TABLE 12B-continued

| TONERS J-L | EX 2-1 | EX 2-2 | EX 2-3 | EX 2-4 | EX 2-5 | EX 2-6 | EX 2-7 | EX 2-8 | EX 2-9 |
|---|---|---|---|---|---|---|---|---|---|
| FILMING | GOOD | GOOD | GOOD | GOOD | GOOD | GOOD | GOOD | GOOD | GOOD |
| FIXING | POOR | POOR | POOR | POOR | POOR | POOR | POOR | POOR | POOR |
| OFFSET | FAIR | FAIR | FAIR | FAIR | FAIR | GOOD | GOOD | GOOD | GOOD |

Evaluation was performed using toners J-L. The evaluation results were substantially the same for all of the toners J-L.

For Comparisons 2-9 and 2-10, the evaluation results for filming, fixing performance, and offset were substantially the same at the line pressure in the range of 34-68 gf/cm, i.e., filming did not occur, and fixing performance was good but offset occurred.

For Comparison 2-11, the line pressure was too low to form a thin layer of toner on the developing roller 22, and good print quality was not obtained during initial printing. Therefore, evaluation was not made for a line pressure of 30 gf/cm and a circumferential speeds higher than 150 mm/sec.

For Comparisons 2-12 to 2-14, the evaluation results of filming and fixing performance at line pressures in the range of 34-73 gf/cm were essentially the same. In other words, fixing performance was good but filming occurred. Because filming occurred for Comparisons 2-12 to 2-14, offset was not evaluated on the next morning.

For Comparison 2-12, filming occurred at a circumferential speed of 150 mm/sec and under a line pressure of 73 gf/cm. This suggests that filming occurs at a line pressure of 73 gf/cm and at circumferential speeds higher than 150 mm/sec. Therefore, evaluation was not made at a line pressure of 73 gf/cm and circumferential speeds higher than 150 mm/sec.

Examples 2-1 to 2-5, a slight residual image was observed on the first page of a solid image. The residual image was trivial and occurred only on the first page.

Examples 2-1 to 2-5 were evaluated at a circumferential speed of 150/sec for different line pressures. The evaluation results of filming, fixing performance, and offset at line pressures in the range of 43-68 gf/cm were essentially the same. In other words, the filming did not occur, fixing performance was good, and offset was trivial.

Examples 2-6 and 2-7 were evaluated at a circumferential speed of 200 mm/sec for different line pressures.

Examples 2-8 and 2-9 were evaluated at a circumferential speed of 250 mm/sec for different line pressures.

For Examples 2-6 to 2-9, the evaluation results of filming, fixing performance, and offset at line pressures in the range of 43-68 gf/cm were essentially the same. In other words, filming did not occur, fixing performance was good, and offset did not occur.

Evaluation was performed in a mid-humidity and mid-temperature environment where temperature is 23° C. and humidity is 55%. Similar evaluation results were obtained in the following two different environments: a low-humidity and low-temperature environment where temperature is 10° C. and humidity is 20%, and a high-temperature and high-humidity environment where temperature is 28° C. and humidity is 80%.

In the second embodiment, blocks of toners were made by kneading, and then the blocks were pulverized into commonly referred to as pulverized toners. As long as Tg, Ts, Tfb, and Tm are within the previously mentioned ranges, the evaluation results do not vary with the manner in which toner is manufactured.

As described above, when the circumferential speed is equal to or lower than 200 mm/sec, only a small amount of offset occurs. However, the offset occurs only under limited conditions and is trivial.

If an image forming apparatus operates at a circumferential speed in the range of 150-250 mm/sec, preferably 200-250 mm/sec and at a line pressure in the range of 34-68 gf/cm, and a toner having a glass transition temperature Tg in the range of 45-77° C., a softening temperature Ts in the range of 63-98° C., a flow-beginning temperature Tfb in the range of 83-138° C., and a melting point Tm in the range of 109-189° C., then not only Tg but also Ts, Tfb, and Tm contribute to improving the characteristics of toner, so that filming and offset can be prevented and fixing performance is improved. This improves print quality.

Although the present invention has been described with respect to an image forming apparatus incorporating only one developing unit, the invention may also be applied to an image forming apparatus that incorporates a plurality of developing units for images of different colors (e.g., black, yellow, magenta, and cyan images).

The first embodiment has been described in terms of the transfer roller 16 and the second embodiment has been described with respect to the transfer unit 41. Other types of transfer device may be used including a transfer drum type where paper is tacked to a transfer drum and a toner image formed on a photoconductive drum is transferred onto the paper, and an intermediate transfer type where a toner image formed on a photoconductive drum is first transferred onto an intermediate transfer body and the toner image is further transferred from the intermediate transfer body onto paper.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus comprising:

an image-bearing body on which an electrostatic latent image is formed;

a developer-bearing body disposed to oppose said image-bearing body, said developer-bearing body supplying developer to the electrostatic latent image to form a visible image formed of the developer;

a layer-forming member that is in contact with said developer-bearing body and forms a thin layer of the developer on said developer-bearing body;

a transfer unit that transfers the visible image onto a recording medium; and a fixing unit that fixes the visible image into a permanent image;

wherein said developer-bearing body rotates at a circumferential speed of 150-250 mm/sec;

wherein said layer-forming member applies a line pressure in the range of 34-68 gf/cm to said developer-bearing body;

wherein the developer has a glass transition temperature in the range of 45-77° C., a softening temperature in the range of 58-98° C., a flow-beginning temperature in the range of 78-138° C., and a melting point in the range of 105-189° C., wherein the melting point is higher than the flow-beginning temperature, and the flow-beginning temperature is higher than the softening temperature.

2. The image forming apparatus according to claim 1, wherein said fixing unit includes:

a first rotating body disposed to oppose a first surface of recording medium onto which the visible image is transferred;

a heater that heats said first rotating body; and a second rotating body disposed to oppose a second surface of the recording medium opposite to the first surface, at least a circumferential surface of said second rotating body being covered with a resilient member.

3. The image forming apparatus according to claim 2, wherein the circumferential speed is in the range of 200-250 mm/sec.

4. The image forming apparatus according to claim 3, wherein the developer is a non-magnetic one-component developer.

5. The image forming apparatus according to claim 2, wherein the developer is a non-magnetic one-component developer.

6. The image forming apparatus according to claim 1, wherein the circumferential speed is in the range of 200-250 mm/sec.

7. The image forming apparatus according to claim 6, wherein the developer is a non-magnetic one-component developer.

8. The image forming apparatus according to claim 1, wherein the developer is a non-magnetic one-component developer.

9. An image forming apparatus comprising:

an image-bearing body on which an electrostatic latent image is formed;

a developer-bearing body disposed to oppose said image-bearing body, said developer-bearing body supplying developer to the electrostatic latent image to form a visible image formed of the developer;

a layer-forming member that is in contact with said developer-bearing body and forms a thin layer of the developer on said developer-bearing body;

a transfer unit that transfers the visible image onto a recording medium; and a fixing unit that fixes the visible image into a permanent image;

wherein said developer-bearing body rotates at a circumferential speed of 150-250 mm/sec;

wherein said layer-forming member applies a line pressure in the range of 34-68 gf/cm to said developer-bearing body;

wherein the developer has a glass transition temperature in the range of 45-77° C., a softening temperature in the range of 63-98° C., a flow-beginning temperature in the range of 83-138° C., and a melting point in the range of 109-189° C., wherein melting point is higher than the flow-beginning temperature, and the flow-beginning temperature is higher than softening temperature.

10. The image forming apparatus according to claim 9, wherein said fixing unit includes:

a first rotating body disposed to oppose a first surface of a recording medium onto which the visible image is transferred;

a first heater that heats said first rotating body;

a second rotating body disposed to oppose a second surface of the recording medium opposite to the first surface, said second rotating body being covered with a resilient member; and a second heater that heats said second rotating body.

11. The image forming apparatus according to claim 10, wherein the circumferential speed is in the range of 200-250 mm/sec.

12. The image forming apparatus according to claim 11, wherein the developer is a non-magnetic one-component developer.

13. The image forming apparatus according to claim 10, wherein the developer is a non-magnetic one-component developer.

14. The image forming apparatus according to claim 10, wherein the first rotating body is formed of a resilient material.

15. The image forming apparatus according to claim 9, wherein the circumferential speed is in the range of 200-250 mm/sec.

16. The image forming apparatus according to claim 15, wherein the developer is a non-magnetic one-component developer.

17. The image forming apparatus according to claim 9, wherein the developer is a non-magnetic one-component developer.

* * * * *